US006877501B2

(12) United States Patent
Wojtkiewicz et al.

(10) Patent No.: US 6,877,501 B2
(45) Date of Patent: Apr. 12, 2005

(54) BALL LAUNCHING APPARATUS

(75) Inventors: Mark Wojtkiewicz, Lancaster, NY (US); Ross Rumfola, III, Akron, NY (US); Kevin R. Shinn, Westfalls, NY (US); Dave Moomaw, East Auroroa, NY (US)

(73) Assignee: Mattel, Inc., El Segundo, CA (US)

( * ) Notice: Subject to any disclaimer, the term of this patent is extended or adjusted under 35 U.S.C. 154(b) by 100 days.

(21) Appl. No.: 10/633,671

(22) Filed: Aug. 5, 2003

(65) Prior Publication Data

US 2004/0084041 A1 May 6, 2004

Related U.S. Application Data

(62) Division of application No. 10/024,509, filed on Dec. 21, 2001, now Pat. No. 6,637,422.

(51) Int. Cl.[7] ..... F41B 4/00
(52) U.S. Cl. ..... 124/78
(58) Field of Search ..... 124/1, 6, 78, 82

(56) References Cited

U.S. PATENT DOCUMENTS

| | | | |
|---|---|---|---|
| 3,084,680 | A | 4/1963 | Goldfarb et al. |
| 3,511,225 | A | 5/1970 | Yokoi |
| 3,734,075 | A | 5/1973 | Staples |
| 3,926,170 | A | 12/1975 | Dixon |
| 3,977,386 | A | 8/1976 | Meyer |
| 3,989,027 | A | 11/1976 | Kahelin |
| 4,026,261 | A | 5/1977 | Paulson et al. |
| 4,086,903 | A | 5/1978 | Scott |
| 4,193,591 | A | 3/1980 | Paulson |
| 4,209,004 | A | 6/1980 | Kennedy |
| 4,261,319 | A | 4/1981 | Dixon |
| 4,323,047 | A | 4/1982 | McIntosh et al. |
| 4,368,885 | A | 1/1983 | Katada et al. |
| 4,423,717 | A | 1/1984 | Kahelin |
| 4,552,120 | A | 11/1985 | Nall et al. |
| 4,596,230 | A | 6/1986 | Griffith |
| 4,615,325 | A | 10/1986 | Yamamura et al. |
| 4,632,088 | A | 12/1986 | Bruce |
| 4,655,190 | A | 4/1987 | Harris |
| 4,669,444 | A | 6/1987 | Whitfield et al. |
| 4,723,532 | A | 2/1988 | Osojnak |
| 4,760,835 | A | 8/1988 | Paulson et al. |
| 4,823,763 | A | 4/1989 | Ponza |
| 4,834,060 | A | 5/1989 | Greene |
| 5,012,790 | A | 5/1991 | Bates |
| 5,031,910 | A | 7/1991 | Kopp |
| 5,224,701 | A | 7/1993 | Sciarrillo et al. |
| 5,257,615 | A | 11/1993 | Jones |
| 5,396,876 | A | 3/1995 | Liscio et al. |
| 5,417,196 | A | 5/1995 | Morrison et al. |
| 5,447,144 | A | 9/1995 | Ivy |
| 5,496,025 | A | 3/1996 | Phillips et al. |
| 5,613,678 | A | 3/1997 | McKee et al. |
| 5,619,977 | A | 4/1997 | Gatin |
| 5,649,523 | A | 7/1997 | Scott |
| 5,676,120 | A | 10/1997 | Joseph |
| 5,813,391 | A | 9/1998 | Johnson |
| 5,832,909 | A | 11/1998 | Grant et al. |
| 5,865,161 | A | 2/1999 | Bruce |
| 6,190,271 | B1 | 2/2001 | Rappaport et al. |

FOREIGN PATENT DOCUMENTS

| | | |
|---|---|---|
| DE | 3407972 A1 | 10/1985 |
| JP | 11-114118 | 4/1999 |

OTHER PUBLICATIONS

Illustration of the Rawlings "Power Pitch 'N Hit" Deluxe Radio Control Pitch Machine, Hammacher Schlemmer* Company, Inc., 2002, p. 7 (www.hammacher.com).

*Primary Examiner*—John A. Ricci
(74) *Attorney, Agent, or Firm*—Cooley Godward LLP

(57) ABSTRACT

A ball launching apparatus configured to launch balls to a user. The ball launching apparatus is configured such that a user may change an angle of trajectory T of launched balls by simply resting the ball launching apparatus on one of two different base portions. The ball launching apparatus is configured to receive, feed, and launch balls having different shapes, such as baseballs and footballs. A ball feed mechanism of the ball launching apparatus is driven by ball propulsion mechanism of the ball launching apparatus.

16 Claims, 12 Drawing Sheets

28
30
40e
40f
40g
42
44
46
48
60
62
66
R
CR
P

BALL LAUNCHING APPARATUS

This application is a divisional application of application Ser. No. 10/024,509, filed Dec. 21, 2001, the entire content of which is hereby incorporated by reference.

BACKGROUND OF THE INVENTION

1. Field of the Invention

The present invention relates to sports and, more particularly, to an apparatus that launches balls.

2. Description of the Related Art

A number of conventional devices are configured to propel balls, such as baseballs, footballs, tennis balls, etc. Some of these ball launching devices are capable of changing the angle of trajectory of a ball propelled from the device. To achieve this feature, most conventional ball launching devices have complex constructions that require numerous moving parts, such as pivotable connections and adjustment mechanisms. Although these constructions sometimes permit adequate adjustment of the trajectory angle, they are too complicated for use by children and are too costly to manufacture and market as children's toys.

In addition, many ball launching devices are configured such that they cannot feed and propel balls having different shapes. Hence, a first ball launching device is required to propel American type footballs and a second, differently configured, ball launching device is required to propel baseballs.

SUMMARY OF THE INVENTION

Generally speaking, the embodiments of the present invention strive to provide a ball launching apparatus having a simple construction that permits a user to easily change the trajectory angle of balls launched from the apparatus.

Further embodiments of the present invention strive to provide a ball launching apparatus that is configured to propel differently shaped balls, such as oval balls and spherical balls.

Additional embodiments of the present invention strive to provide a ball launching apparatus having a ball feed mechanism and a ball propulsion mechansim, where the ball launching apparatus is configured such that the ball feed mechansim is driven by the ball propulsion mechanism.

Other advantages and features associated with the present invention will become more readily apparent to those skilled in the art from the following detailed description. As will be realized, the invention is capable of other and different embodiments, and its several details are capable of modification in various obvious aspects, all without departing from the invention. Accordingly, the drawings and the description are to be regarded as illustrative in nature, and not limitative.

DETAILED DESCRIPTION OF THE PREFERRED EMBODIMENTS

Figure 1:
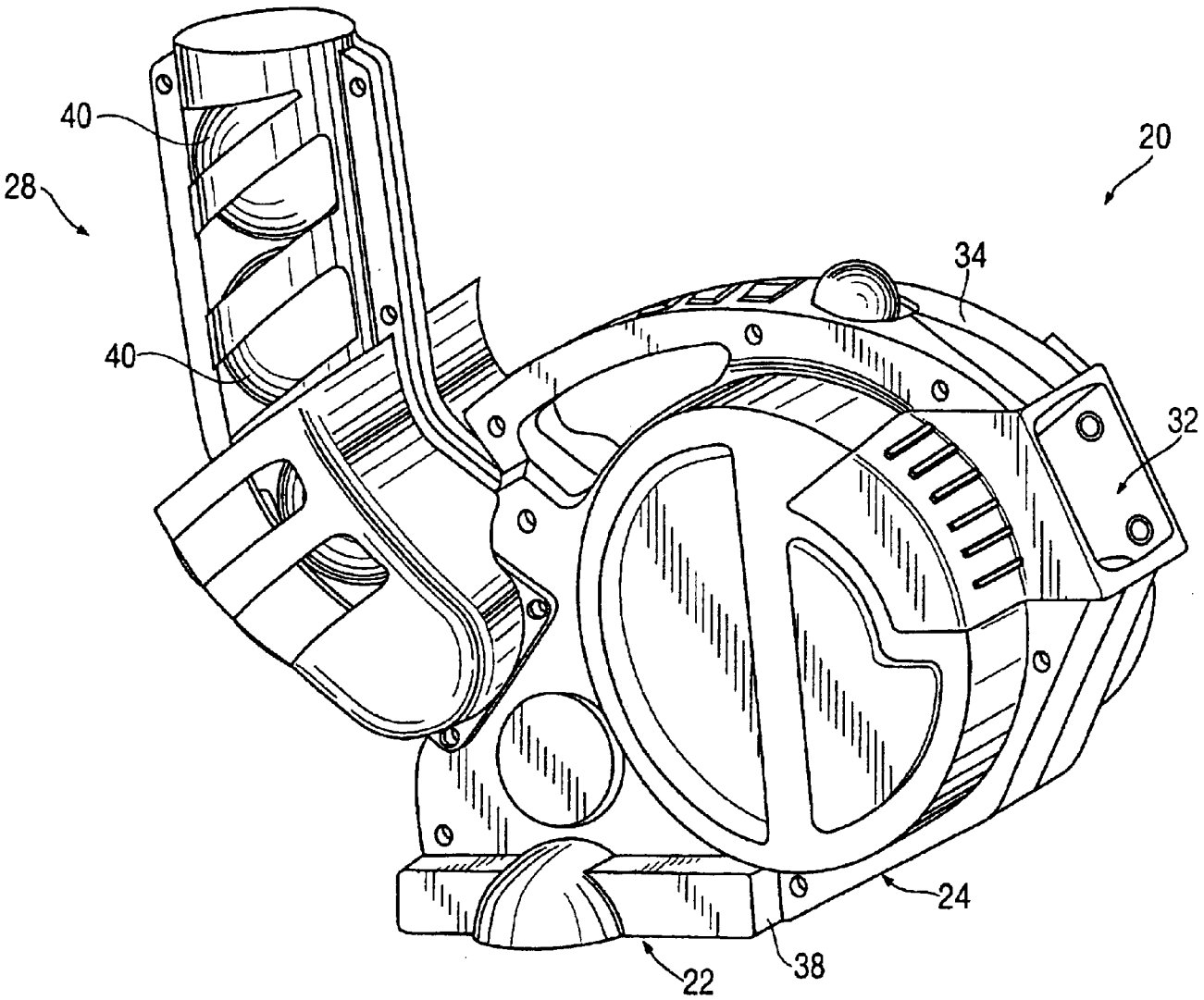
FIG. 1 is a perspective view of a ball launching apparatus in accordance with one embodiment of the present invention.
Figure 2:
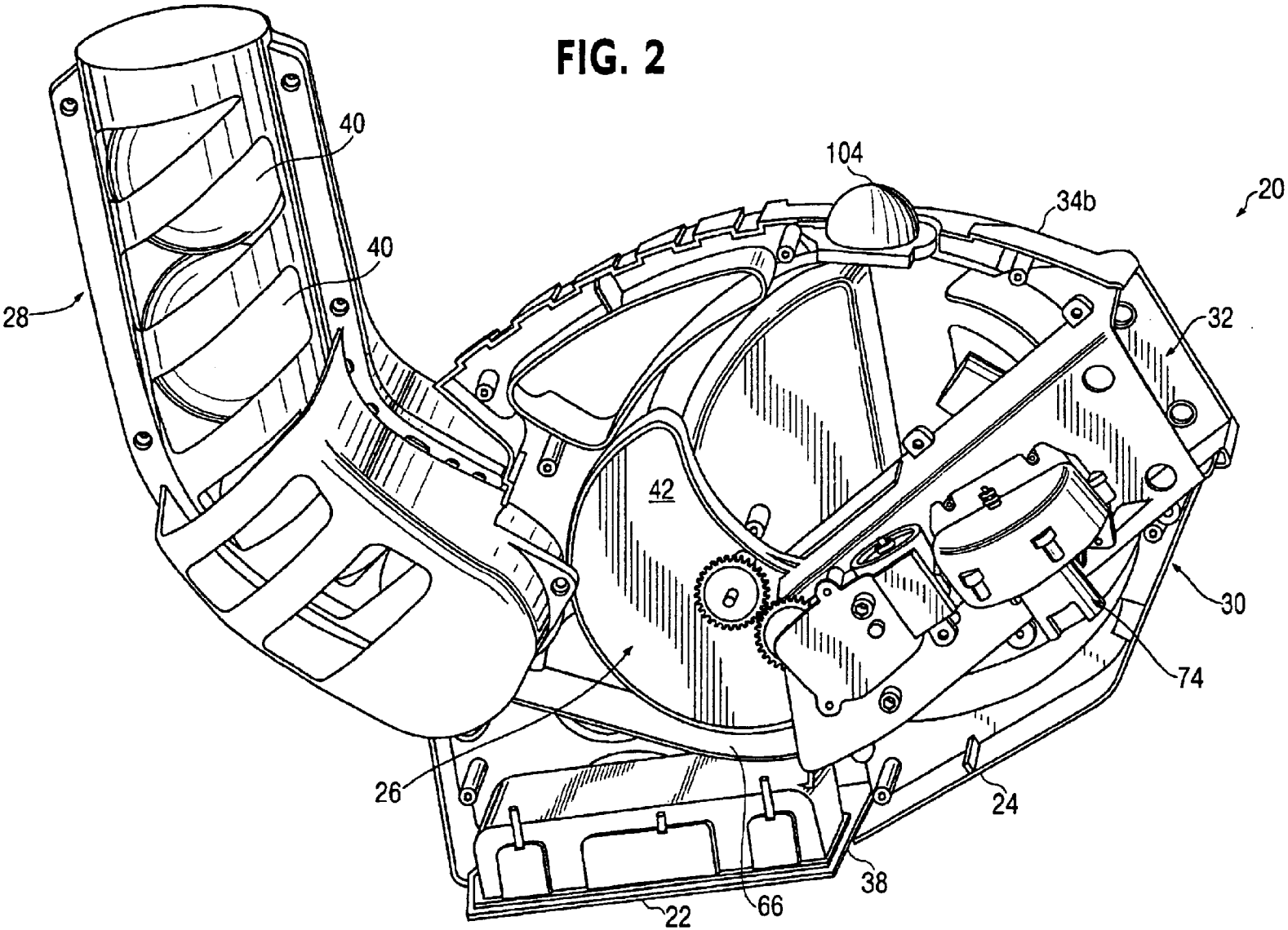
FIG. 2 is a perspective view of the ball launching apparatus illustrated in FIG. 1, where a first half of a housing of the ball launching apparatus has been removed to illustrate the interior of the ball launching apparatus.
Figure 3:
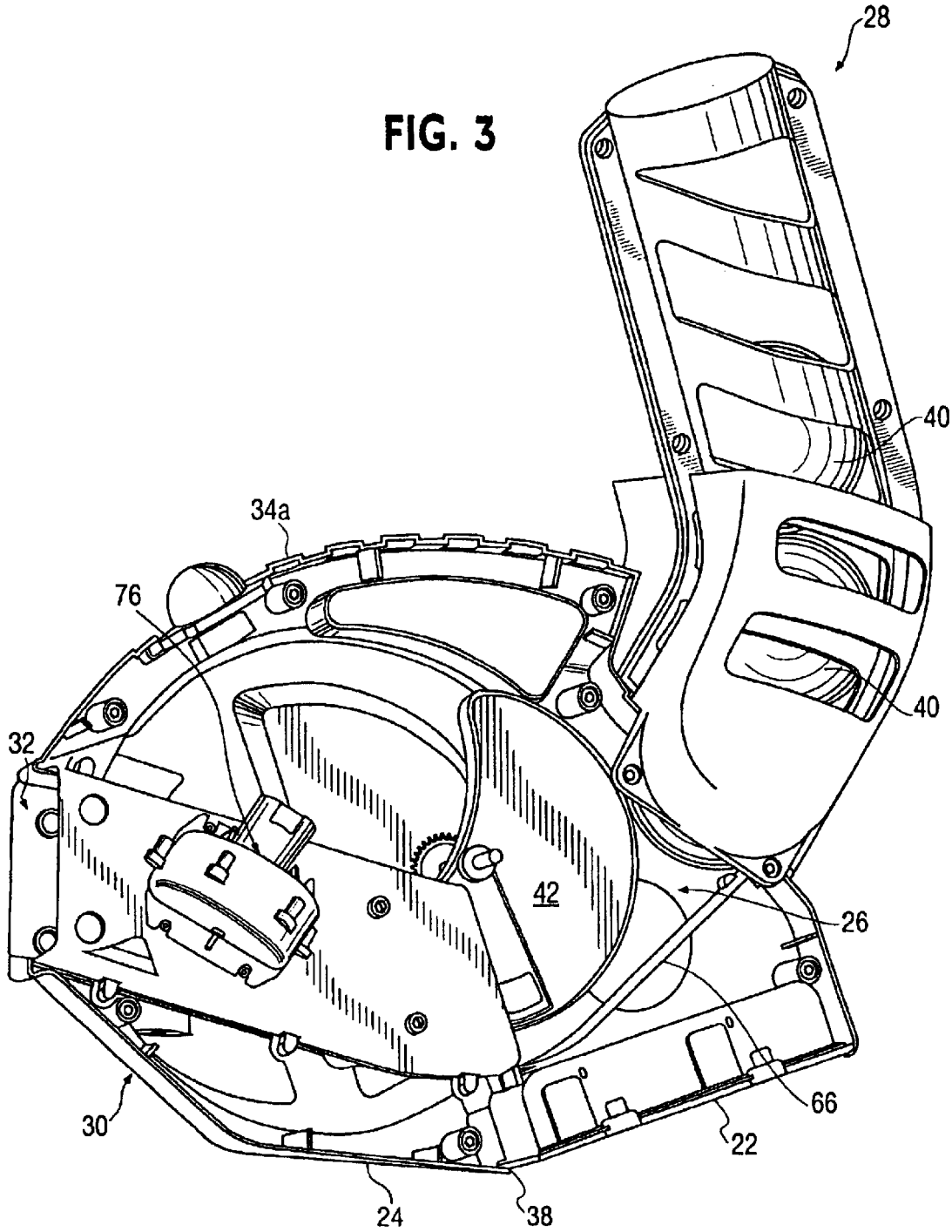
FIG. 3 is a perspective view of the ball launching apparatus illustrated in FIG. 1, where a second half of the housing has been removed to illustrate the interior of the ball launching apparatus.

FIGS. 1–11 illustrate one embodiment of a ball launching apparatus 20 in accordance with the present invention. The ball launching apparatus 20 is a device configured to launch balls to a user such that the user can catch the balls or strike the balls with a bat, a racket, a hockey stick, etc. As described further below and by way of overview, the ball launching apparatus 20 has a number of features, one of which is that the ball launching apparatus is configured such that a user may change an angle of trajectory T of launched balls by simply resting the ball launching apparatus on a different one of two different base portions 22, 24. Another feature is that the ball launching apparatus 20 is configured to receive, feed, and launch balls having different shapes, such as baseballs and footballs. A further feature is that a ball feed mechanism 26 of the ball launching apparatus 20 is driven by ball propulsion mechanism 30 of the ball launching apparatus.

As is illustrated in FIGS. 1–4, the ball feed mechanism 26 of the ball launching apparatus 20 intermittently feeds balls 40 received from a channel 28 to the ball propulsion mechanism 30. The ball propulsion mechanism 30 is configured and located to propel the balls 40 from the ball launching apparatus 20 along a propulsion axis P through a chute 32 in a housing 34 of the ball launching apparatus. The housing 34 at least partially houses the internal components of the ball launching apparatus 20, including the ball feed mechanism 26 and the ball propulsion mechanism 30. The housing 34 includes the first base portion 22 and the second base portion 24, which are portions of the housing configured to rest upon a planar support surface 36 and that are sized and located such that the ball launching apparatus 20 is self-supported when either the first base portion 22 or the second base portion 24 rests upon the planar support surface 36. That is, the base portions 22, 24 are sized and the center of gravity of the ball launching apparatus 20 is located relative to the first and second base portions 22, 24 such that when either the first base portion or the second base portion is rested upon the planar support surface 36 the ball launching apparatus will not fall over and is independently maintained in the upright positions illustrated in FIGS. 5A and 5B.

In the illustrated embodiment, the housing 34 is defined by three housing sections 34*a*, 34*b*, 34*c* that connect to each other to house the ball feed mechanism 26 and the ball propulsion mechanism 30. Each housing section 34*a*, 34*b*, 34*c* defines a portion of the base portions 22, 24. In alternative embodiments, the first base portion 22 and the second base portion 24 are defined by one or more different sections of the housing 34. For example, in one embodiment, the housing 34 is formed by four housing sections that connect to each other to define the base portions 22, 24. In a further embodiment, the base portions 22, 24 are defined by one section of the housing.

In the illustrated embodiment of the ball launching apparatus 20, the first base portion 22 and the second base portion 24 are approximately planar surfaces of the housing 34 that share a common straight edge 38 and that are obliquely angled with respect to each other. However, the base portions 22, 24 may take other configurations. For example, in an alternative embodiment of the ball launching apparatus 20, the base portions 22, 24 are non-planar surfaces that do not share a common edge. In a further embodiment, the base portions 22, 24 include legs, posts, or other protrusions that rest upon the planar support surface 36. In another embodiment of the ball launching apparatus 20, the housing 34 includes additional base surfaces that a user may rest upon the planar support surface 36 to locate the ball launching apparatus at other self supported positions.

As is described further below, the propulsion axis P of balls propelled from the ball launching apparatus 20 is located at a fixed location with respect to the housing 34 because the ball propulsion mechanism 30 is attached to the housing 34 or another item of the ball launching apparatus in such a manner that the ball propulsion mechanism is immovable relative to the housing. Because the propulsion axis P is at a fixed location relative to the housing 34, a user of the ball launching apparatus 20 may change the trajectory angle T of balls launched from the ball launching apparatus 20 by simply repositioning the ball launching apparatus to the aforementioned self-supporting positions, where the either first base portion 22 or the second base portion 24 rests upon the planar support surface 36.

Figure 5A:
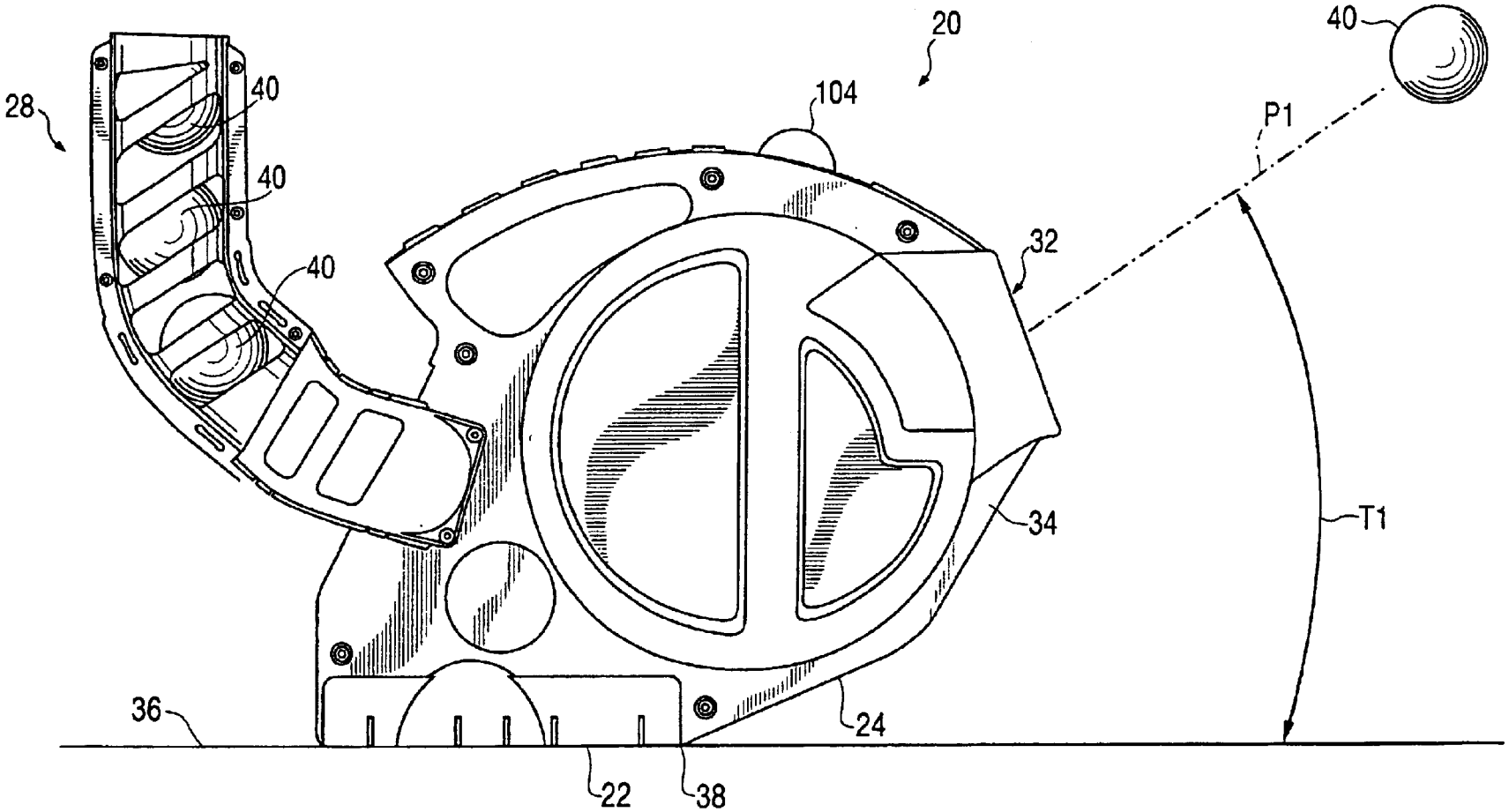
FIG. 5A is an operational side view of the ball launching apparatus illustrated in FIG. 1, where a ball is being propelled from the ball launching apparatus while a first base portion of the ball launching apparatus is resting upon a planar support surface.
Figure 5B:
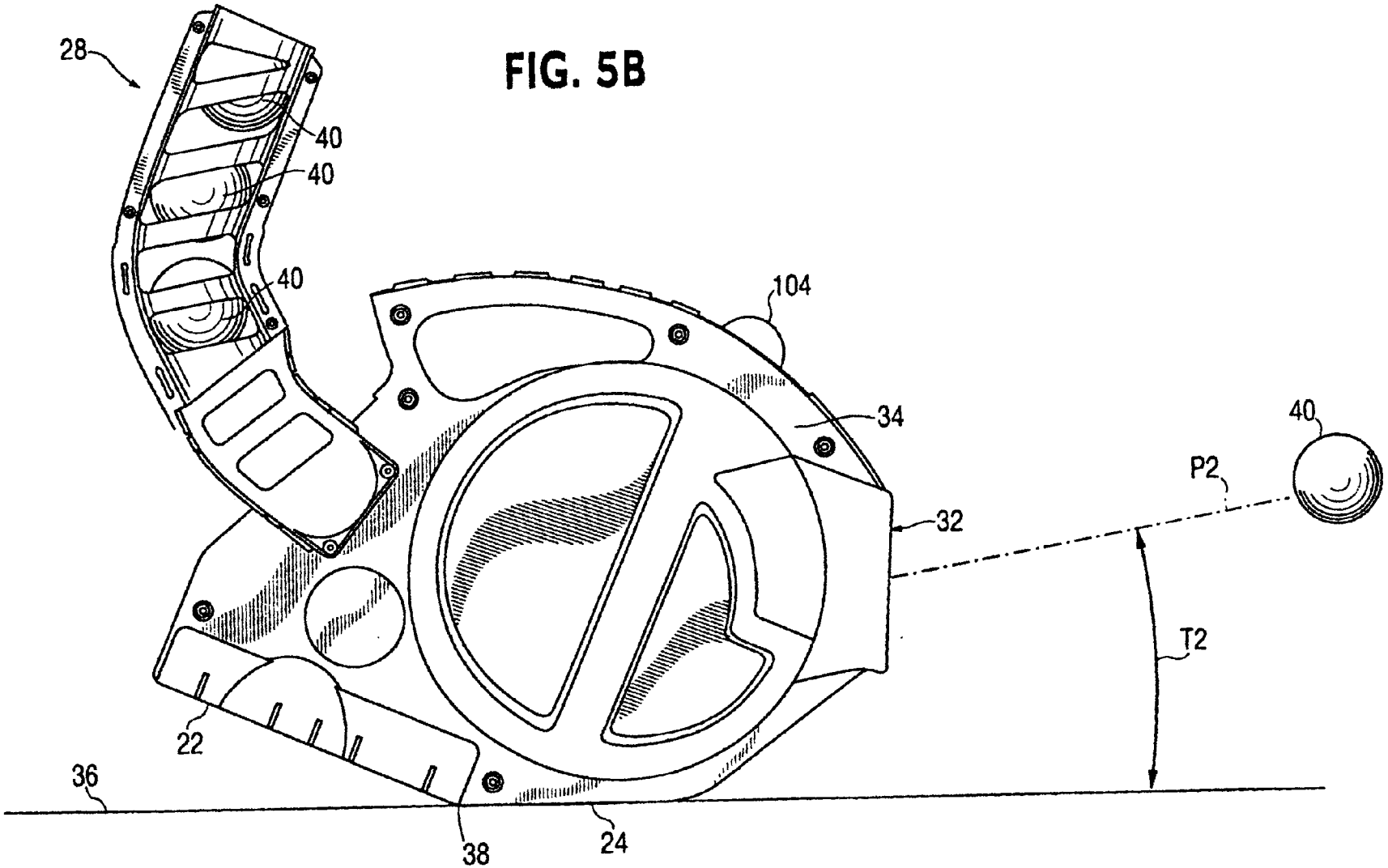
FIG. 5B is an operational side view of the ball launching apparatus illustrated in FIG. 1, where a ball is being propelled from the ball launching apparatus while a second base portion of the ball launching apparatus is resting upon a planar support surface.

As is illustrated in FIG. 5A, when the first base portion 22 of the ball launching apparatus 20 rests upon the planar support surface 36, the propulsion axis P1 is located at a first trajectory angle T1 with respect to the planar support surface 36. As illustrated in FIG. 5B, when the second base portion 24 is rested upon the planar support surface 36, the propulsion axis P2 is located at a second trajectory angle T2 with respect to the planar support surface 36. The first trajectory angle T1 is greater than the second trajectory angle T2, preferably such that the propulsion axis P1 when at the first trajectory angle T1 is obliquely angled with respect to the propulsion axis P2 when at the second trajectory angle T2. The first base portion 22 and the second base portion 24 are preferably configured and located such that the first trajectory angle T1 is between 0–30 degrees and the second trajectory angle T2 is between 10–50 degrees. More preferably, the first base portion 22 and the second base portion 24 are preferably configured and located with respect to each other such that the first trajectory angle T1 is between 1–20 degrees and the second trajectory angle T2 is between 15–45 degrees. In a particularly preferred embodiment, the first base portion 22 and the second base portion 24 are configured and located such that the first trajectory angle T1 is approximately 10 degrees when the first base portion 22 rests upon the planar support surface 36 and such that the second trajectory angle T2 is approximately 34 degrees when the second base portion rests upon the planar support surface. In this particular embodiment, the first base portion 22 is thus at an angle of approximately 24 degrees with respect to the second base portion, such that the propulsion axis P is rotated approximately 24 degrees about an axis roughly parallel to both the first base portion 22 and the second base portion 24 when the ball launching apparatus is moved from the first self-supported position illustrated in FIG. 5A to the second self-supported position illustrated in FIG. 5B, or vice versa As is apparent from FIGS. 5A and 5B, if a user of the ball launching apparatus 20 desires to launch balls having a high trajectory, the user will position the ball launching apparatus such that the first base portion 22 rests upon the planar support surface 36. For example, the user will position the ball launching apparatus 20 such that the first base portion 22 rests upon the planar support surface 36 if the user desires to catch a long football pass or hit a high baseball pitch. If the user desires a lower trajectory, the user will position the ball launching apparatus 20 such that the second base portion 24 rests upon the planar support surface 36. For example, the user will position the ball launching apparatus 20 such that the second base portion 24 rests upon the planar support surface 36 if the user desires to strike a hockey ball or if the user desires to field a ground baseball hit. Thus, the user may change the trajectory angle T by simply moving the ball launching apparatus 20 itself, which greatly simplifies the construction of the ball launching apparatus as compared to some conventional designs that offer adjustable trajectory angles.

When the ball launching apparatus 20 is located at either of the self-supported positions illustrated in Figures SA and 5B, where either the first base portion 22 or the second base portion 24 rests upon the planar support surface 36, the ball launching apparatus 20 is located such that the channel 28 will gravity feed the balls to the ball feed mechanism 26. In the illustrated embodiment, the channel 28 is a passageway, ramp, conduit, or feed path that guides or channels balls to the ball feed mechanism 26. In the preferred embodiment, the channel 28 is sized such that the balls 40 located therein are arranged in single file order, i.e., one ball follows another ball. In an alternative embodiment, the ball launching apparatus 20 includes a bin, bucket, basket, or other container that holds balls for delivery to the channel 28.

The ball feed mechanism 26 is a device that intermittently feeds balls to the ball propulsion mechanism 30. In accordance with different embodiments of the ball launching apparatus 20, the ball feed mechanism 26 takes different forms. For example, the ball feed mechanism 26 may be similar to that described in U.S. Pat. Nos. 3,084,680; 4,323,047; 4,552,120; 4,669,444; 4,834,060; 5,396,876; 5,417,196; 5,619,977; and 6,190,271, the entire disclosures of which are hereby incorporated by reference.

Figure 6:
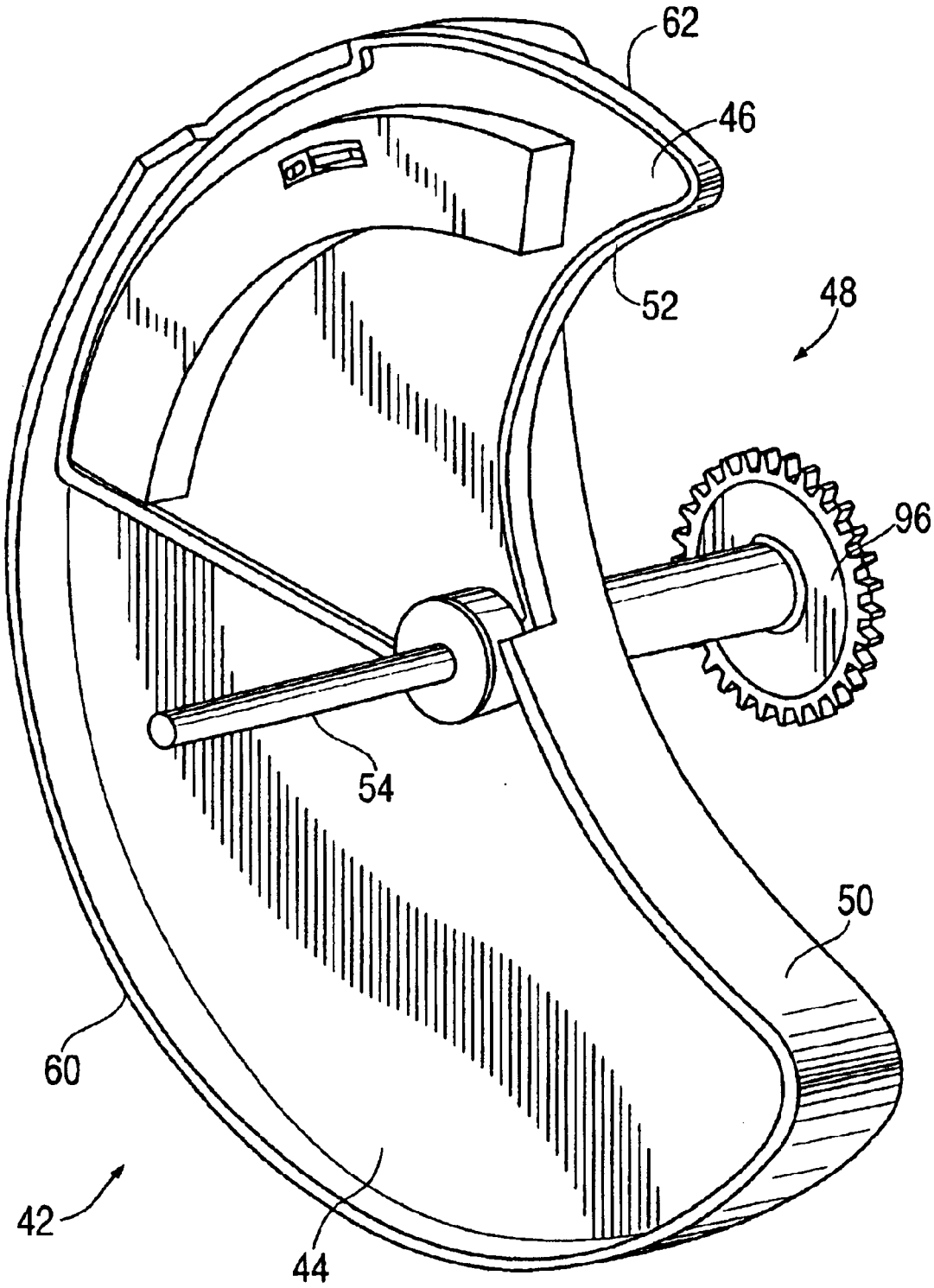
FIG. 6 is a perspective view of a wheel of a ball feed mechanism of the ball launching apparatus illustrated in FIG. 1 and in accordance with one embodiment of the present invention.
Figure 7:
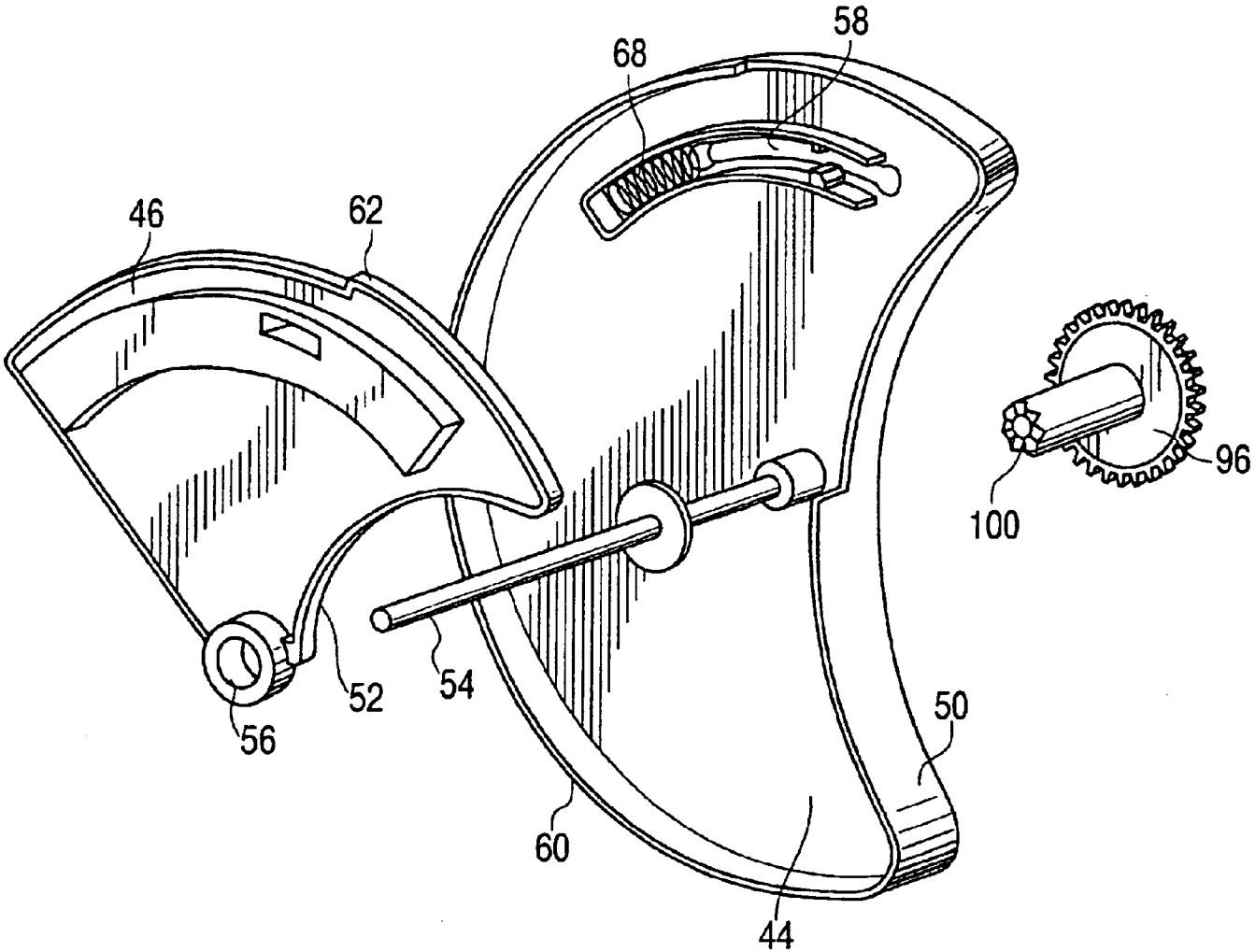
FIGS. 7 and 8 are front and rear exploded views of the wheel illustrated in FIG. 6.
Figure 8:
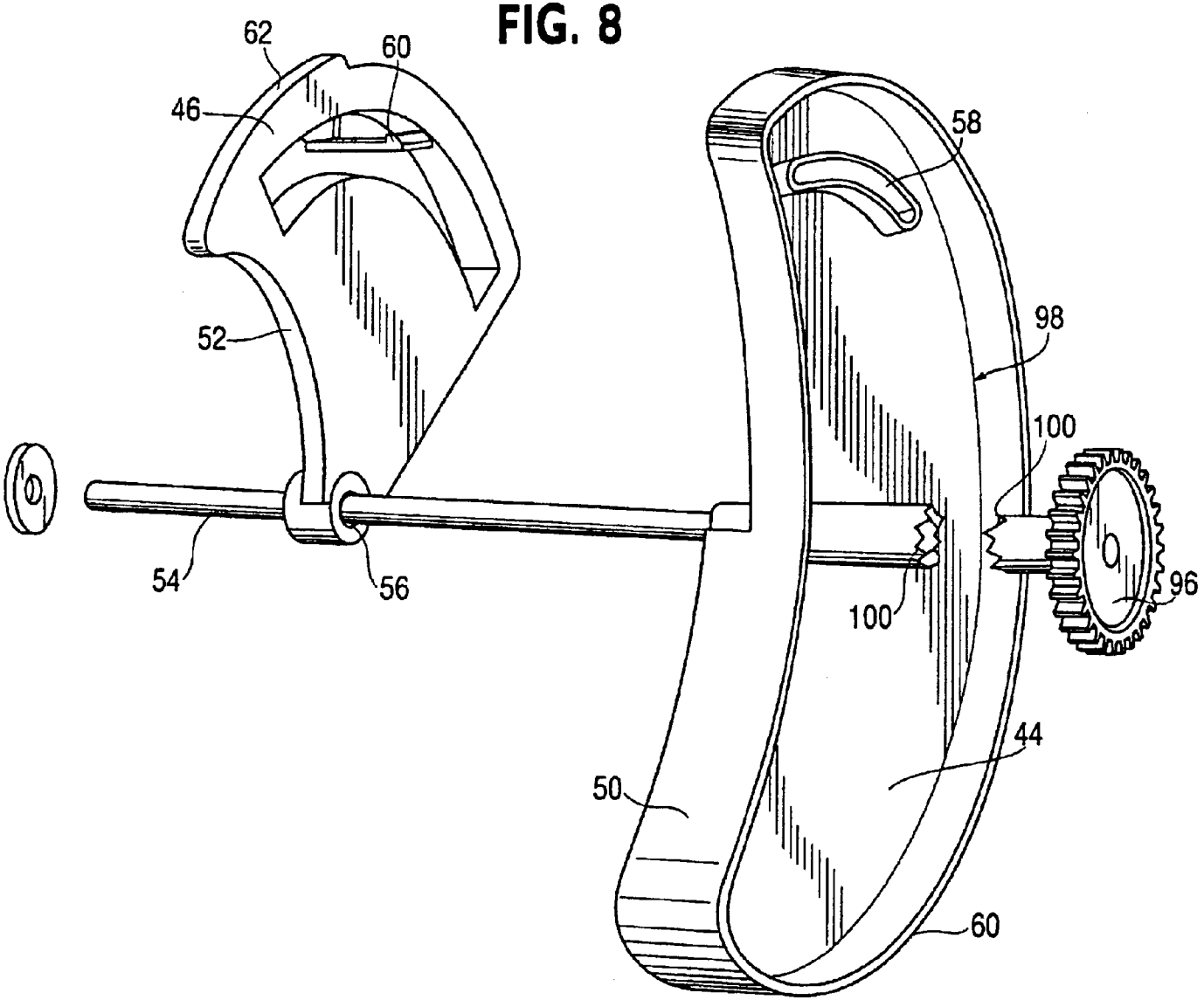

One preferred embodiment of the ball feed mechanism 26 is illustrated in FIGS. 1–11. As is illustrated in FIGS. 6–8, the ball feed mechanism 26 includes a rotatable wheel 42, which is a device that rotates about an axis to feed balls to the ball propulsion mechanism 30. In the illustrated embodiment, the wheel 42 is defined by at least a first member 44 and a second member 46, which are each generally shaped like sectors of a circle. In the preferred embodiment, the second member 46 defines a smaller sector than the first member 44. The first member 44 preferably has a partially circular periphery 60 and a concave indentation defined by a surface 50, and the second member 46 preferably has a partially circular periphery 62 and a concave indentation defined by a surface 52. As is illustrated in FIGS. 8 and 10, the space between the between the surface 50 of the first member 44 and the surface 52 of the second member 46 defines a recess 48 in the wheel 42 that is sized to receive one of the balls 40*a–d*.

Figure 9:
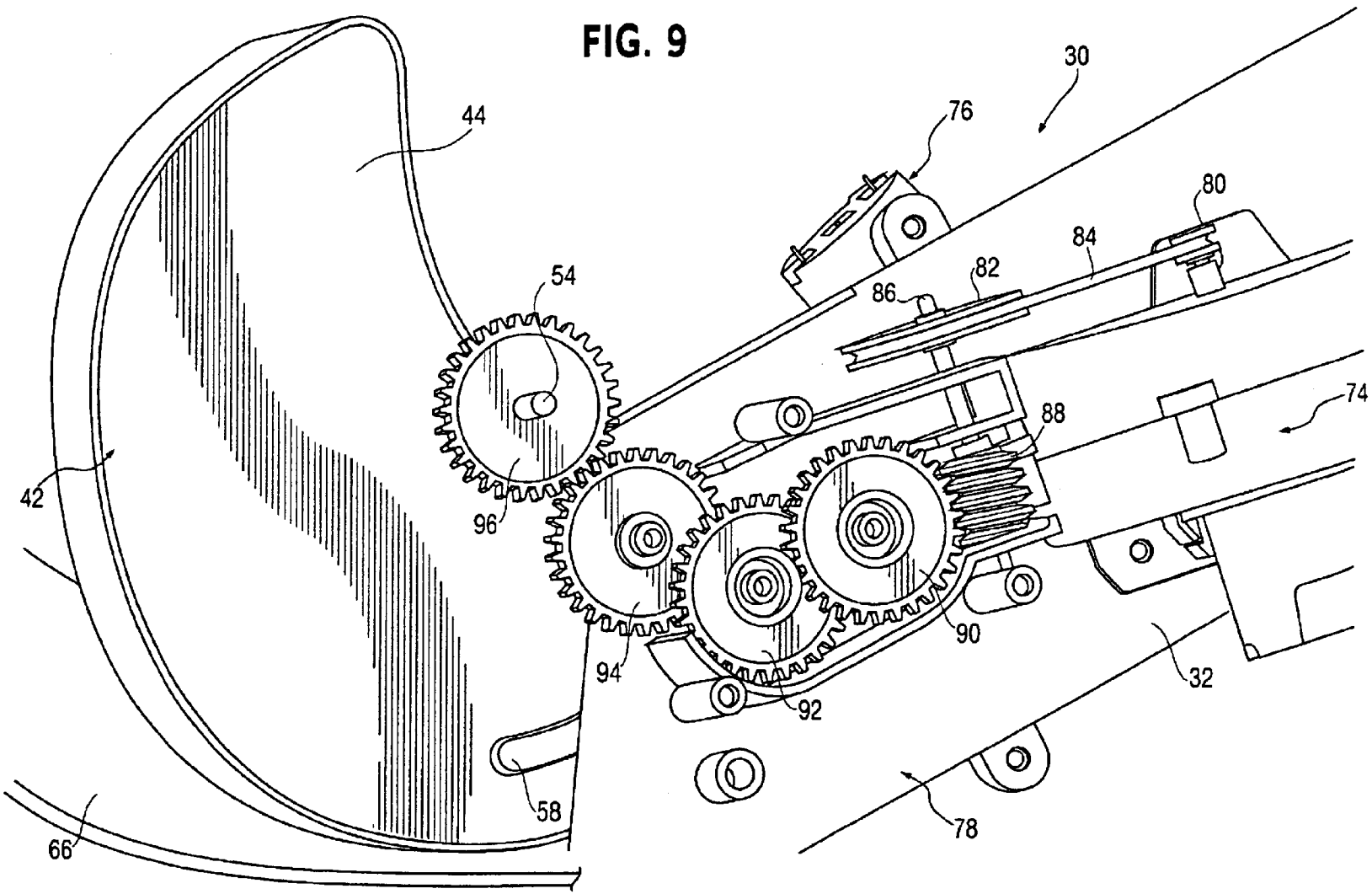
FIG. 9 is a partial perspective view of a drive train of the ball launching apparatus illustrated in FIG. 1, where the drive train rotatably connects the wheel and a motor of a ball propulsion mechanism in accordance with one embodiment of the present invention.
Figures 10A, 10B, 10C, 10D, 10E:
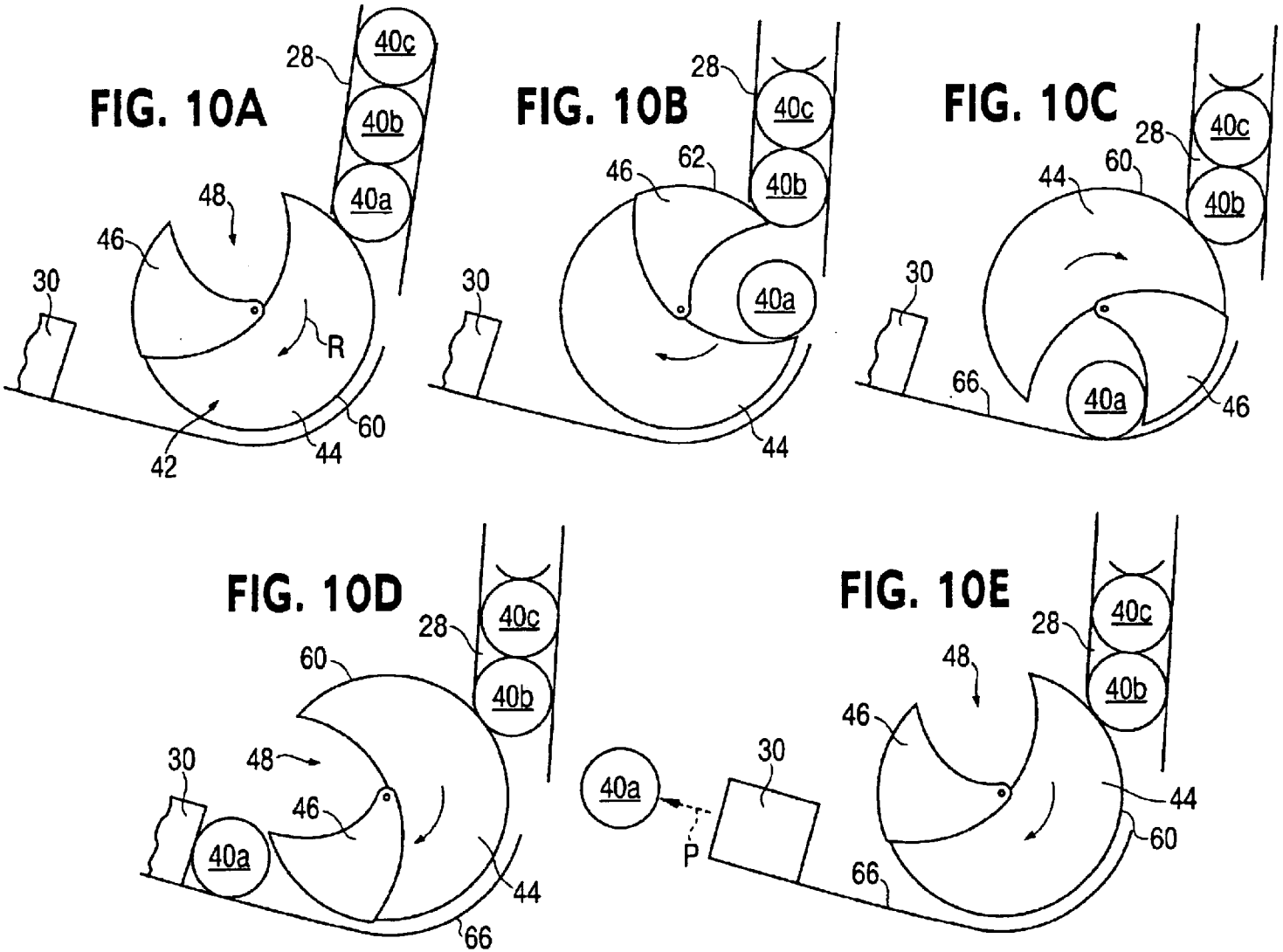
FIG. 10A is an operational view of the ball feed mechanism of the ball launching apparatus illustrated in FIG. 1, where the wheel of the ball launching mechanism is illustrated at time t1, at which time it prevents a spherical ball from being fed to the ball propulsion mechanism.
FIG. 10B is an operational view of the ball feed mechanism of the ball launching apparatus illustrated in FIG. 1, where the wheel of the ball launching mechanism is illustrated at time t2, at which time a recess in the wheel has received the spherical ball.
FIG. 10C is an operational view of the ball feed mechanism of the ball launching apparatus illustrated in FIG. 1, where the wheel of the ball launching mechanism is illustrated at time t3, at which time the wheel has rotated to partially feed the received spherical ball and at which time the wheel is preventing the next spherical ball from being fed.
FIG. 10D is an operational view of the ball feed mechanism of the ball launching apparatus illustrated in FIG. 1, where the wheel of the ball launching mechanism is illustrated at time t4, at which time it has fed the received spherical ball to the ball propulsion mechanism and at which time the wheel is preventing the next spherical ball from being fed.
FIG. 10E is an operational view of the ball feed mechanism of the ball launching apparatus illustrated in FIG. 1, where the wheel of the ball launching mechanism is illustrated at time t5, at which time the previously received spherical ball has been propelled from the ball propulsion mechanism and at which time the wheel is rotating into position to receive the next spherical ball.

FIGS. 10A–10E illustrate the ball feed mechanism 26 at successive points in time t1–t5 to demonstrate how the ball feed mechanism 26 intermittently feeds balls 40 to the ball propulsion mechanism 30. FIG. 10A illustrates the ball feed mechanism 26 at time t1, at which time the wheel 42 is rotating in a direction of rotation R and the periphery 60 of the rotating first member 44 prevents the spherical ball 40*a* from being fed to the ball propulsion mechanism 30. The spherical ball 40*a* abuts the partially circular periphery 60 during rotation of the wheel 42 such that it is not fed toward the ball propulsion mechanism. FIG. 10B illustrates the ball feed mechanism 26 at time t2, at which time the wheel 42 has rotated just past a position at which the recess 48 received the spherical ball 40*a* from the channel 28. As is illustrated in FIG. 10B, the periphery 62 of the second member 44 prevents the next ball 40*b* from being fed to the ball propulsion mechanism 30 during rotation of the wheel. FIG. 10C illustrates the ball feed mechanism 26 at time t3, at which time the wheel 42 has rotated to partially feed the received spherical ball 40*a* and at which time the periphery 60 of the first member 44 prevents the next spherical ball 40*b* from being fed. FIG. 10D illustrates the ball feed mechanism at time t4, at which time the recess 48 has rotated to feed the received spherical ball 40*a* to the ball propulsion mechanism 30 and at which time the periphery 60 of the first member prevents the next spherical ball 40*b* from being fed. As is illustrated in FIGS. 2, 3, 9, 10C, and 10D the housing 34 includes a ledge 66 that abuts the received ball 40*a* during rotation of the wheel 42 until the ball 40*a* is delivered to the ball propulsion mechanism 30. The ledge 66 prevents the ball 40*a* in the recess 48 from completely exiting the recess until the wheel 42 has rotated to a position to deliver the received ball 40*a* to the ball propulsion mechanism 30. Hence, the ledge 66 includes an upstream portion that follows the circular periphery of the wheel 42 and a downstream portion that deviates from the circular periphery. In the illustrated embodiment, the ledge 66 tangentially deviates from a path that follows the circular periphery of the wheel 42. In an alternative embodiment, the ledge 66 abruptly stops at a location where the ball 40*a* is loaded to the ball propulsion device 30. In a further embodiment, the ledge 66 curves in a direction skewed with respect to the plane of the wheel 42 so as to direct the ball to the ball propulsion mechanism 30.

As is illustrated in FIG. 10D, after the leading edge of the first member 44 rotates to a position adjacent that portion of the ledge 66 that no longer follows the periphery of the wheel 42, the ball. 40*a* exits the recess and is pushed into the ball propulsion mechanism 30 by the leading edge of the second member 46. FIG. 10E illustrates the ball feed mechanism 26 at time t5, at which time the previously received spherical ball 40a has been propelled from the ball propulsion mechanism 30 and at which time the wheel 42 is rotating into position to receive the next spherical ball 40*b*.

As is described above, one ball 40 is fed to the ball propulsion mechanism during one rotation of the wheel. However, in alternative embodiments of the ball feed mechanism 26, multiple balls are conveyed to the ball feed mechanism during one revolution of the wheel 42. For example, in one embodiment, the wheel 42 includes two recesses 48 each sized to receive one ball such that two balls are individually fed to the ball feed mechanism 30 during one revolution of the ball feed mechanism.

One feature of the preferred ball launching apparatus 20 is that it is configured to receive, feed, and launch balls having different shapes. Hence, the ball feed mechanism 26 is configured such that it can feed spherical balls 40*a–d,* such as baseballs, hockey balls, tennis balls etc, and oval balls 40*e–g,* such as American footballs and rugby balls. In a preferred embodiment of the ball launching apparatus 20 intended for use with children, the balls 40*a–g* are fabricated from blow-molded plastic. The preferred spherical balls 40*a–d* have a diameter that is approximately equal to the width of the oval balls 40*e–g* (measured along an axis perpendicular to the longitudinal center axis of the oval ball). As is apparent from FIG. 4, the length of the oval balls 40*e–g* is greater than the diameter of the spherical balls 40*a–d.* However, in alternative embodiments, the oval and spherical balls have different diameters and widths. For example, embodiments of the ball launching apparatus 20 may be configured for use with conventional balls, such as conventional softballs and footballs. In further embodiments, the balls may take other shapes, such as cylindrical hockey pucks.

To accommodate the differently shaped balls 40*a–g,* the second member 46 is moveable with respect to the first member 44 so as to increase a size of the recess 48 between the surfaces 50, 52. In reference to FIGS. 6–8, a shaft 54 is mounted to the first member 44, and the second member 46 has a throughole 56 that receives the shaft such that the second member 46 is rotatable about the shaft. The first member 44 has an elongated slot 58 that receives a protrusion 60 of the second member 46 in such a manner that the protrusion 60 is moveable with respect to the first member 44 along a length of the elongated slot 58 when rotating about the shaft 54. In this manner the second member 46 is moveably coupled to the first member 44 such that the second member is movable relative to the first member when rotating about the shaft 54 and when the wheel 42 is rotating relative to the housing 34. Because the protrusion 60 can only move within the elongated slot 58, the range of motion of the second member 46 is restricted by the length of the slot. In an alternative embodiment, movement of the second member 46 is not guided by a coupling between the first member 44 and the second member. Rather, the range of motion of the second member 46 is restricted by a pin, cam, or ledge on the shaft 54 or another item of the ball launching apparatus. In a further embodiment, the second member 46 is rotatable about a pivotable connection separate from the shaft 54. For example, the second member 46 may be pivotable about a pin of the first member 44 that is spaced from the shaft 54.

As is illustrated in FIG. 7, a compression spring 68 is located in the slot 58. The spring 68 biases the second member 46 toward the first member 44 such that the second member 46 is biased at a first position where the recess 48 is large enough to receive one of the a spherical balls 40*a–d,* but is too small to receive one of the oval-shaped balls 40*e–g.* However, when a force is incident on the second member 46 sufficient to compress the spring 68, the second member 46 will move relative to the first member 44 to a second position at which the recess 48 is large enough to receive one of the oval-shaped balls 40*e–g.* In an alternative embodiment, the second member 46 is biased toward the first member 44 by a torsion spring mounted to the shaft 54.

Figures 11A, 11B, 11C, 11D, 11E, 11F:
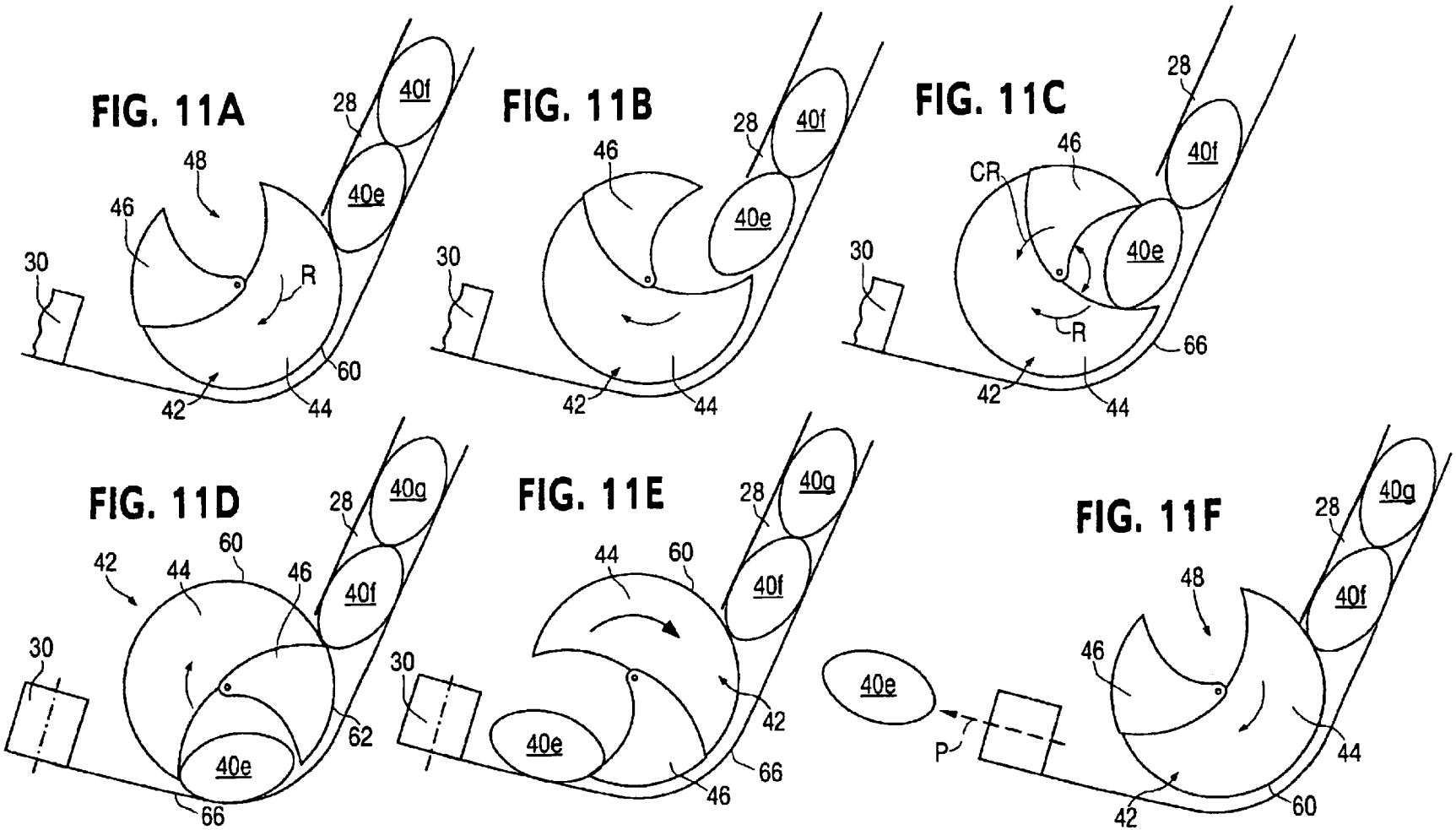
FIG. 11A is an operational view of the ball feed mechanism of the ball launching apparatus illustrated in FIG. 1, where the wheel of the ball launching mechanism is illustrated at time t1, at which time the wheel prevents an oval ball from being fed to the ball propulsion mechanism.
FIG. 11B is an operational view of the ball feed mechanism of the ball launching apparatus illustrated in FIG. 1, where the wheel of the ball launching mechanism is illustrated at time t2, at which time a recess in the wheel has partially received the oval ball.
FIG. 11C is an operational view of the ball feed mechanism of the ball launching apparatus illustrated in FIG. 1, where the wheel of the ball launching mechanism is illustrated at time t3, at which time the size of the recess in the wheel is increasing to accommodate the oval ball.
FIG. 11D is an operational view of the ball feed mechanism of the ball launching apparatus illustrated in FIG. 1, where the wheel of the ball launching mechanism is illustrated at time t4, at which time the size of the recess in the wheel has increased to receive the oval ball, at which time the wheel has rotated to partially feed the received oval ball, and at which time the wheel is preventing the next oval ball from being fed.
FIG. 11E is an operational view of the ball feed mechanism of the ball launching apparatus illustrated in FIG. 1, where the wheel of the ball launching mechanism is illustrated at time t5, at which time the wheel is about to feed the received oval ball to the ball propulsion mechanism and at which time the wheel is preventing the next ball from being fed.
FIG. 11F is an operational view of the ball feed mechanism of the ball launching apparatus illustrated in FIG. 1, where the wheel of the ball launching mechanism is illustrated at time t6, at which time the oval ball has been propelled from the ball propulsion mechanism, at which time the wheel is rotating into position to receive the next oval ball, and at which time the size of the recess in the wheel has reduced to its original size.

FIGS. 11A–11F illustrate the ball feed mechanism 26 at successive points in time t1–t5 to demonstrate how the ball feed mechanism 26 intermittently feeds differently shaped balls 40 to the ball propulsion mechanism 30. FIG. 11A illustrates the ball feed mechanism 26 at time t1, at which time the ball feed mechanism 26 has just fed the spherical ball 40*d* and is about to feed the oval ball 40*e.* At time t1, the periphery 60 of the rotating first member 44 prevents the oval ball 40*e* from being fed to the ball propulsion mechanism 30. The ball 40*e* abuts the partially circular periphery 60 during rotation of the wheel 42 such that it is not fed toward the ball propulsion mechanism 30. FIG. 11B illustrates the ball feed mechanism at time t2, at which time the wheel 42 has rotated just past a position at which the recess 48 received a portion of the oval ball 40*e* from the channel 28. As is illustrated by FIG. 11B, the oval ball 40*e* is too large to fit within the recess 48 when the second member 46 located at the aforementioned first position. That is, when the second member 46 is at the biased first position, the recess 48 is just large enough to accommodate the diameter of one of the spherical balls 40*a–d,* but to small to accommodate the length of one of the oval balls 40*e–g.*

As illustrated in FIG. 11C, as the wheel 42 rotates, the second member 46 will abut the oval ball 40*e,* which in turn abuts the ledge 66 and/or the chute 28; this imparts a force on the second member 46 sufficient to compress the spring 68 so as to cause the second member to move relative to the first member 44 in a direction CR opposite to the direction of rotation R of the wheel. Hence, at time t3 illustrated in FIG. 11C, the size of the recess 48 in the wheel 42 is increasing to accommodate the oval ball 40*e.* FIG. 11D illustrates the ball feed mechanism 26 at time t4, at which time the recess 48 has increased in size to receive the oval ball 40*e*, the wheel 42 has rotated to partially feed the received oval ball 40*e*, and the periphery 62 of the second member 44 prevents the next oval ball 40f from being fed.

FIG. 11E illustrates the ball feed mechanism at a time t5, at which time the wheel 42 has rotated to such an extent that the received oval ball 40*e* is about to be fed to the ball propulsion mechanism 30 and at which time the periphery 60 of the first member 44 is preventing the next oval ball 40*f* from being fed. FIG. 11F illustrates the ball feed mechanism 26 at time t6, at which time the previously received oval ball 40*e* has been fed to and propelled by the ball propulsion mechanism 30 and at which time the wheel 42 is rotating into position to receive the next spherical ball 40*b.* As is illustrated by FIG. 11F, after the oval ball 40*e* has been fed from the recess 48, the force of the spring 68 on the protrusion 60 will force the second member 46 back to the first position such that the recess 48 returns to its original size. In this manner, the ball feed mechanism 26 of the ball launching apparatus 20 is configured to receive and feed differently shaped balls.

In alternative embodiments of the present invention, the ball feed mechanism 26 takes other configurations. For example, in one embodiment of the ball launching apparatus 20, the surfaces 50, 52 do not define concave indentations as they are planar surfaces of the first and second members 44, 46. In another embodiment, each periphery 60, 62 of the first and second members 44, 46 is non-circular. In another embodiment, the first and second members 44, 46 rotate independently of one another. In addition, the wheel 42 may reciprocate rather than rotate continuously. For example, in one embodiment, the wheel 42 rotates from a first position at which it receives a ball and then reverses rotational direction to feed the received ball to the ball feed mechanism 26. In a further embodiment, the rotational axis of the wheel 42 is perpendicular to that illustrated in FIGS. 1–11. In still a further embodiment, the members that define the adjustable recess 48 move along a linear path to receive and feed the balls. For example, the members that define the adjustable recess 48 may reciprocate along one linear path to receive and feed the balls, or may move along a linear path and then rotate to reverse the linear direction, similar to a belt on two rotating pulleys.

As described above, the differently shaped balls 40*a–g* are fed from the ball feed mechanism 26 to the ball propulsion mechanism 30. The ball propulsion mechanism 30 is a device that accelerates balls fed from the ball feed mechanism 26 to such an extent that the balls are launched from the ball launching apparatus 20. In accordance with different embodiments of the ball launching apparatus 20, the ball propulsion mechanism 30 takes different forms. For example, the ball propulsion mechanism 30 may be similar to that described in U.S. Pat. Nos. 3,084,680; 4,323,047; 4,552,120; 4,669,444; 4,834,060; 5,396,876; 5,417,196; 5,496,025; 5,619,977; and 6,190,271, the entire disclosures of which are hereby incorporated by reference.

In the preferred embodiment, the ball propulsion mechanism 30 includes two opposed rollers 70, 72 that are each driven by a motor 74, 76. Each roller 70,72 is located on opposite sides of the chute 32 and propel balls from the chute by accelerating the balls. In the preferred embodiment, the rotational center axis of the rollers 70, 72 are skewed with respect to each other such that a spin is imparted to balls launched from the ball launching apparatus. In an alternative embodiment, the rotational axis of the rollers 70, 72 are parallel to each other.

As described above, the ball propulsion mechanism 30 is attached to the housing 34 in such a manner that the ball propulsion mechanism is immovable relative to the housing. That is, the ball propulsion mechanism 30 is at a fixed location with respect to the housing 34. Hence, the propulsion axis P of balls propelled from the ball launching apparatus 20 is also at a fixed location with respect to the housing. In the illustrated embodiment, the motors 74, 76 are attached to portions of the chute 32, which is are attached to the housing 34. In this manner, the ball propulsion mechanism 30 and the propulsion axis P are at fixed locations with respect to the housing 34. In an alternative embodiment of the ball launching apparatus 20, the ball propulsion mechanism 30 is not fixed with respect to the housing, but is adjustable so as to adjust the trajectory angle T, similar to that described in U.S. Pat. No. 6,190,271.

As is illustrated in FIG. 9, the ball launching apparatus 20 includes a drive train 78 that rotatably connects the motor 74 and the wheel 42 of the ball feed mechanism 26. In the preferred embodiment, the motor 74 drives a pulley 80, which is coupled to another pulley 82 by a belt 84. The pulley 82 is mounted on a shaft 86, which rotates a worm gear 88. The worm gear 88 in turn drives train of spur gears 90, 92, 94, 96. The spur gear 96 is coupled to the shaft 54 of the ball feed mechanism 26 such that the shaft and wheel 42 rotate with the spur gear 96. In this manner, the drive train 78 rotatable connects the motor 74 and the wheel 42 of the ball feed mechanism 26. Because the drive train 78 rotatably connects the motor 72 and the wheel 42, the ball launching apparatus 20 need not include an additional motor to drive rotation of the wheel, greatly simplifying the construction of the ball launching apparatus as compared to some conventional devices and resulting in lower cost.

As is illustrated in FIG. 8, in the preferred embodiment, the drive train 78 includes a clutch 98 that limits transmission of power from the motor 74 along the drive train when torque on the wheel 42 or in the drive train exceeds a predetermined value. For example, if user of the ball launching apparatus accidentally locates an object in the chute 28 other than one of the balls 40, the ball feed mechanism may jam, causing a high torque situation. If this occurs, the clutch 98 will trip such that the gears 88–96 and/or the motor 74 are not damaged. In the preferred embodiment, the clutch 98 is of the dog or ratcheting type, having a plurality of mating male and female members 100 that will ratchet over one another when the clutch is tripped. However, the clutch 98 may take other forms in alternative embodiments of the ball launching apparatus 20. For example, in alternative embodiments, the clutch 98 may be a coil clutch, cone clutch, disk clutch, etc. In a further embodiment of the ball launching apparatus 20, the drive train 78 does not include a clutch.

In the preferred embodiment, the drive train 78 reduces the rotational speed of the motor 74 such that the wheel 42 rotates at approximately 7.5 revolutions pert minute. In this manner, the ball launching apparatus will feed one ball every 8 seconds. In alternative embodiments, the drive train 78 takes other configurations. For example, in one embodiment, the drive train 78 does not include pulleys and a belt. In a further embodiment, the drive train 78 rotatably connects both motors 74, 76 to the wheel 42. In another embodiment, the drive train 78 includes a cam and follower. In a further embodiment, the drive train 78 includes one or more rollers that drive rotation of the wheel. In a further embodiment, the drive train 78 rotatably connects the motor 74 and the first member 44, and rotatably connects the motor 76 and the second member 46.

Figure 4:
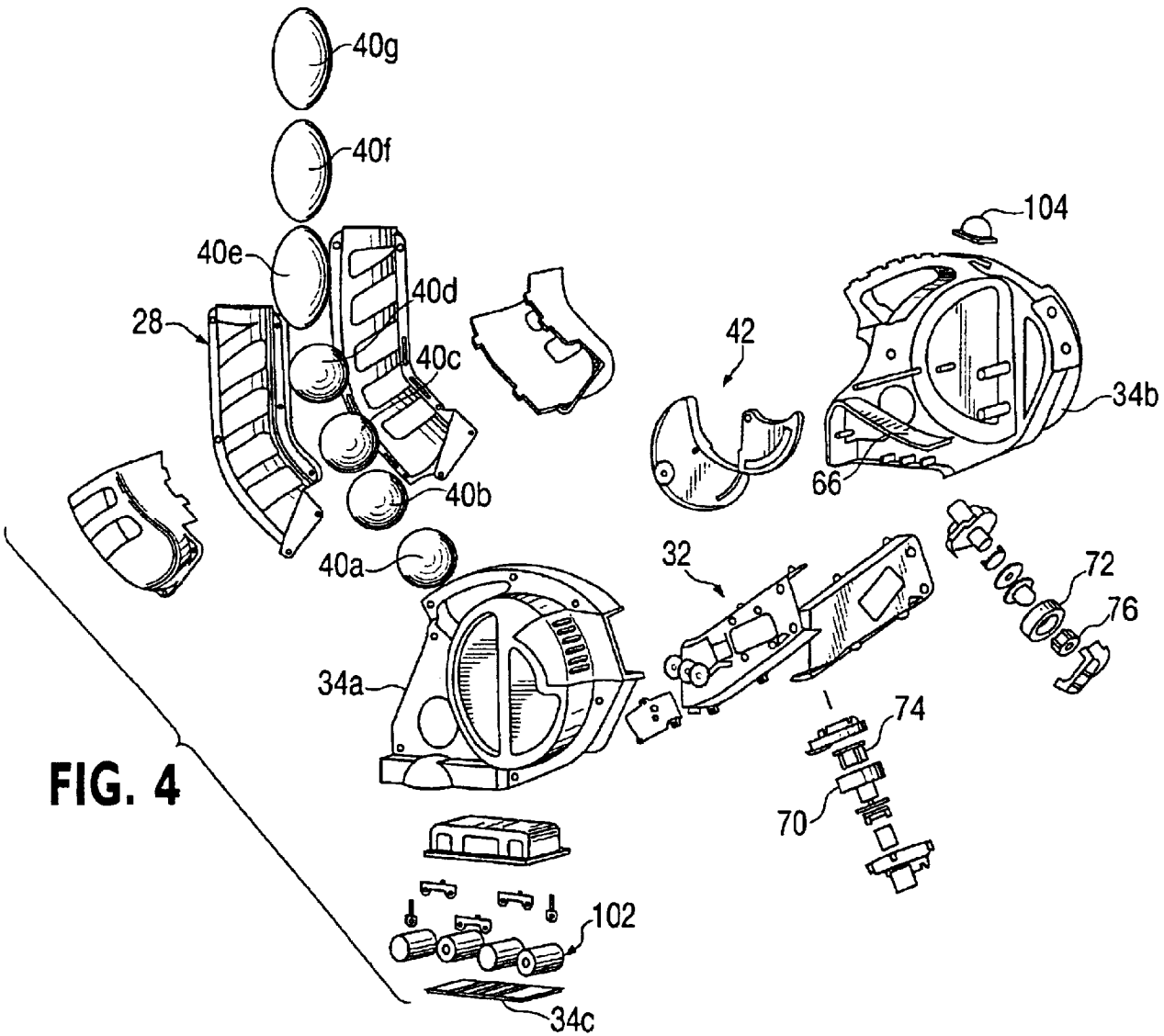
FIG. 4 is an exploded view of the ball launching apparatus illustrated in FIG. 1.

As is illustrated in FIG. 4, the motors of the ball launching apparatus are powered by a power source 102. In the preferred embodiment, the power source includes DC batteries. In an alternative embodiment, the ball launching apparatus is powered by an AC power source external of the ball launching apparatus 20. Power may be supplied to the motors by actuating a switch 104. In the preferred embodiment, the motors and the rate of balls fed by the ball feed mechanism may be run at two different speeds via actuating the switch 104.

As will be appreciated from the foregoing, the ball launching apparatus 20 is advantageously configured such that a user may change the angle of trajectory T of launched balls by simply resting the ball launching apparatus on one of the base portions 22, 24. Further, the ball launching apparatus 20 is advantageously configured to receive, feed, and launch balls having different shapes, such as baseballs and footballs. Additionally, the ball feed mechanism 26 of the ball launching apparatus 20 is advantageously driven by the ball propulsion mechanism 30. Although each of these benefits may be realized by the illustrated embodiment of the ball launching apparatus 20, it will be appreciated that different embodiments of the present invention may be configured to only achieve one and/or two of the aforementioned benefits. For example, in accordance with one embodiment of the present invention the ball launching apparatus is not configured to receive, feed, and launch balls having different shapes, but is configured such that a user may change the angle of trajectory T of launched balls by simply resting the ball launching apparatus on one of the base portions 22, 24. In accordance with another embodiment of the present invention the ball launching apparatus 20 is not configured such that a user may change the angle of trajectory T of launched balls by simply resting the ball launching apparatus on one of the base portions 22, 24, but is configured to receive, feed, and launch balls having different shapes. In accordance with a further embodiment of the present invention, the ball launching apparatus is not configured to receive, feed, and launch balls having different shapes and is not configured such that a user may change the angle of trajectory T of launched balls by resting the ball launching apparatus on one of the base portions 22, 24, but is configured such that the ball feed mechanism 26 is driven by the ball propulsion mechanism 30.

The principles, preferred embodiments, and modes of operation of the present invention have been described in the foregoing description. However, the invention which is intended to be protected is not to be construed as limited to the particular embodiments disclosed. Further, the embodiments described herein are to be regarded as illustrative rather than restrictive.

Variations and changes be made by others, and equivalents employed, without departing from the spirit of the invention. Accordingly, it is expressly intended that all such variations, changes and equivalents which fall within the spirit and scope of the present invention as defined in the claims be embraced thereby.

What is claimed is:

1. A ball launching apparatus comprising:

a ball propulsion mechanism at least partially housed in a housing, said ball propulsion mechanism being configured and located to propel a ball from said housing along a propulsion axis that is at a fixed location with respect to said housing, said housing having a first base portion and a second base portion, said first base portion being inclined with respect to said second base portion, said ball launching apparatus being self-supported when said first base portion rests upon a planar support surface and when said second base portion rests upon the planar support surface, said propulsion axis being at a first position when said first base portion rests upon the planar support surface, said propulsion axis being at a second position when said second base portion rests upon the planar support surface, said propulsion axis when at said second position being obliquely angled with respect to said propulsion axis when at said first position.

2. The ball launching apparatus of claim 1, said ball propulsion mechanism being fixedly attached to at least one item of said ball launching apparatus.

3. The ball launching apparatus of claim 1, said propulsion axis being parallel with the planar support surface when said propulsion axis is located at said first position, said propulsion axis being at an angle with respect to the planar support surface when said propulsion axis is located at said second position.

4. The ball launching apparatus of claim 1, said propulsion axis being at a first angle with respect to the planar support surface when said propulsion axis is located at said first position, said propulsion axis being at a second angle with respect to the planar support surface when said propulsion axis is located at said second position, said second angle being greater than said first angle.

5. The ball launching apparatus of claim 4, said first angle being between 1–30 degrees, said second angle being between 10–50 degrees.

6. The ball launching apparatus of claim 5, said first angle being between 1–20 degrees, said second angle being between 15–45 degrees.

7. The ball launching apparatus of claim 6, said first angle being approximately 10 degrees, said second angle being approximately 34 degrees.

8. The ball launching apparatus of claim 1, said first base portion including a flat surface that abuts the planar support surface when said first base portion rests upon the planar support surface.

9. The ball launching apparatus of claim 8, said second base portion including a flat surface that abuts the planar support surface when said second base portion rests upon the planar support surface.

10. The ball launching apparatus of claim 9, said flat surface of said first base portion and said flat surface of said second base portion having a common edge.

11. The ball launching apparatus of claim 1, said ball propulsion mechanism including at least one motor and a roller driven by said motor.

12. The ball launching apparatus of claim 1, said ball propulsion mechanism including two opposed rollers.

13. The ball launching apparatus of claim 1, said ball propulsion mechanism including a chute from which the ball is propelled.

14. The ball launching apparatus of claim 1, further comprising a ball feed mechanism configured and located to intermittently feed balls to said ball propulsion mechanism.

15. The ball launching apparatus of claim 14, further comprising a channel, said channel being oriented with respect to said ball feed mechanism such that balls in said channel are fed by gravity to said ball feed mechanism when said first base portion rests upon the planar support surface and when said second base portion rests upon the planar support surface.

16. A method comprising:

placing a ball launching apparatus at a first self-supported position where a first base portion of a housing of the ball launching apparatus rests on a planar support surface and where a propulsion axis of a ball propelled from the ball launching apparatus is at a first location, the housing having a second base portion that is inclined with respect to the first base portion; and placing the ball launching apparatus at a second self-supported position where the second base portion rests on the planar support surface and where the propulsion axis is at a second location, the propulsion axis when at the second location being obliquely angled with respect to the propulsion axis when at the first location.

* * * * *

UNITED STATES PATENT AND TRADEMARK OFFICE

CERTIFICATE OF CORRECTION

PATENT NO. : 6,877,501 B2
DATED : April 12, 2005
INVENTOR(S) : Mark Wojtkiewicz et al.

It is certified that error appears in the above-identified patent and that said Letters Patent is hereby corrected as shown below:

Column 5,
Line 36, replace "SA" with -- 5A --.

Column 10,
Line 18, replace "pert" with -- per --.

Column 11,
Line 15, replace "changes be made" with -- changes may be made --.
Line 17, replace "invention" with -- present invention --.

Signed and Sealed this

Twenty-eighth Day of March, 2006

JON W. DUDAS
*Director of the United States Patent and Trademark Office*